US010457057B2

(12) United States Patent
Fielder et al.

(10) Patent No.: US 10,457,057 B2
(45) Date of Patent: Oct. 29, 2019

(54) METHOD FOR DRY SHIPMENT OF PRINTHEADS

(71) Applicant: Memjet Technology Limited, Dublin (IE)

(72) Inventors: Simon Fielder, North Ryde (AU); Ming Chen, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 16/110,611

(22) Filed: Aug. 23, 2018

(65) Prior Publication Data

US 2019/0061358 A1 Feb. 28, 2019

Related U.S. Application Data

(60) Provisional application No. 62/549,380, filed on Aug. 23, 2017.

(51) Int. Cl.
*B41J 2/175* (2006.01)
*B41J 2/165* (2006.01)

(52) U.S. Cl.
CPC ..... *B41J 2/1752* (2013.01); *B41J 2/1652* (2013.01); *B41J 2/16535* (2013.01); *B41J 2/17513* (2013.01); *B41J 2/17533* (2013.01); *B41J 2/16585* (2013.01)

(58) Field of Classification Search
CPC .. B41J 2/1752; B41J 2/17503; B41J 2/17533; B41J 2/17513; B41J 2/16535; B41J 2/16585
See application file for complete search history.

(56) References Cited

U.S. PATENT DOCUMENTS 8,845,083 B2 * 9/2014 Lucas ..... B41J 2/16535 347/89
9,044,945 B2 * 6/2015 North ..... B41J 2/14032

* cited by examiner

*Primary Examiner* — Huan H Tran
(74) *Attorney, Agent, or Firm* — Cooley LLP

(57) ABSTRACT

A method of preparing a printhead for dry shipment. The method includes the steps of: treating an ink pathway in the printhead with an aqueous treatment fluid containing at least one ink-soluble solvent having a boiling point of at least 150 degrees; and drying the printhead so as to leave a film of liquid solvent on a surface of the ink pathway. The film of liquid solvent solubilizes organic materials leached or outgassed from the printhead during dry storage or shipment.

14 Claims, 4 Drawing Sheets

METHOD FOR DRY SHIPMENT OF PRINTHEADS

CROSS-REFERENCE TO RELATED APPLICATIONS

This application claims priority to and the benefit of U.S. Provisional Patent Application No. 62/549,380 entitled METHOD FOR DRY SHIPMENT OF PRINTHEADS, filed Aug. 23, 2017, the disclosure of which is incorporated herein by reference in its entirety.

FIELD OF INVENTION

The disclosed invention relates to a method for dry shipment of inkjet printheads. It has been developed primarily for reducing a number of dead nozzles caused by dry shipment.

BACKGROUND OF THE INVENTION

The present Applicant has previously described a plethora of printers having replaceable printheads. Replaceable printheads typically comprise an ink manifold having one or more of printhead chips mounted thereto. Printheads may be shipped either 'wet' or 'dry' for installation by users. Usually, printheads are shipped 'wet' to avoid potential problems with priming during installation. Wet-shipped printheads may be filled with either ink or a shipping fluid, which is typically an ink vehicle lacking any colorant.

However, wet-shipped printheads are less convenient for users, because ink or shipping fluid leak from the printhead during shipment and/or spill during the installation process. Users would prefer to receive dry printheads, which are not prone to leaking or spilling fluids during shipment or installation.

Dry-shipped printheads are feasible for printers equipped with a suitable ink delivery system capable of priming a dry printhead. The Applicant has disclosed a number of ink delivery systems suitable for priming printheads with ink when installed (see, for example, U.S. Pat. No. 8,845,083, the contents of which are incorporated herein by reference).

However, additional problems are associated with shipment of dry printheads. It has been observed by the present inventors that dry-shipped printheads exhibit a significantly higher number of dead nozzles than wet-shipped printheads. Investigations have shown that there is a tendency for glue joints, potting material and other polymers in the printheads to leach or outgas organic material into ink pathways e.g. by virtue of temperature fluctuations during storage. Organic leachants or volatile organic compounds ("VOCs") are particularly problematic when they reach pinch points in the ink pathway e.g. nozzle chamber inlets, baffle holes, nozzle openings etc. In a dry-shipped printhead, the leachants may bridge across these pinch points and form a viscous plug, which cannot be removed by subsequent priming of the printhead. Accordingly, this leaching process is believed to be responsible for a high number of unrecoverable dead nozzles in dry-shipped printheads compared to those shipped wet.

It would therefore be desirable to provide a method for dry shipment of printheads, which minimizes a number of dead nozzles in the printhead.

SUMMARY OF INVENTION

In a first aspect, there is provided a method of preparing a printhead for dry shipment comprising the steps of:

treating an ink pathway in the printhead with an aqueous treatment fluid comprising at least one ink-soluble solvent having a boiling point of at least 150 degrees; and drying the printhead so as to leave a film of liquid solvent on a surface of the ink pathway, the film of liquid solvent solubilizing organic materials leached or volatilized from the printhead during dry storage or shipment.

The method according to the first aspect advantageously reduces a dead nozzle count in dry-shipped printheads by enabling viscous organic material leached or outgassed during storage or shipment to be solubilized. Accordingly, otherwise unrecoverable viscous plugs of organic contaminants (e.g. leachants) may be removed from the ink pathway during normal priming of the printhead when the printhead is first installed in a printer. Typically, such viscous plugs occur in or around narrow sections of the ink pathway in the vicinity of nozzle chambers.

In some embodiments, the method comprises the step of packaging the printhead.

Preferably, the printhead is packaged together with a desiccant (e.g. silica gel, molecular sieves etc). In some embodiments, the printhead is packaged together with an oxygen scavenger (e.g. iron powder/sodium chloride, activated carbon etc.). Oxygen scavengers advantageously minimize adventitious auto-oxidation and polymerization of leached organic materials, which may reduce their solubility.

Typically, the organic materials are leached or outgassed from at least one of: glue joints in the printhead; potting compounds protecting electronic components; and a polymer encapsulating electrical connections in the printhead.

The ink-soluble solvent is not particularly limited provided that it solubilizes organic leachants; remains on surfaces of the ink pathway as a film during shipment or storage; and is dissolved ink during priming of the printhead. Preferably, the ink-soluble solvent is selected from the group consisting of: glycols (e.g. ethylene glycol, diethylene glycol, triethylene glycol etc.), glycol ethers, sulfolane, glycerol, trimethylolpropane, 2-pyrrolidone and N-methylpyrrolidone.

Preferably, the treatment fluid comprises one or more ingredients selected from the group consisting of: surfactants, biocides and buffers.

Preferably, a total solvent content of the treatment fluid is at least in the range of 0.5 to 3 wt. %, or preferably in the range of 1 to 2 wt. %. The term "total solvent content" is used to mean the total combined amount of ink-soluble solvent(s), as defined above, contained in the treatment fluid. Typically, the water content of the treatment fluid is greater than 97 wt. % or greater than 98 wt. %.

Preferably, a portion of the ink pathway comprises an ink flow portion having a width of less than 20 microns, or less than 15 microns or less than 10 microns. These 'neck' or 'pinch points' in the ink pathway are prone to blockages by viscous plugs of organic contaminants during shipment or storage.

In a second embodiment, there is provided a dry-shipped printhead contained in a sealed package, wherein a film of liquid solvent is deposited on a surface of an ink pathway in the printhead, and wherein the solvent is ink-soluble and has a boiling point of at least 150 degrees.

Typically, the liquid solvent contains solubilized organic material leached or outgassed from the printhead during dry storage or shipment.

Preferably, the film of liquid solvent is immobile.

Preferably, the package additionally contains a desiccant, such as silica gel.

In a third aspect, there is provided a method of priming a dry-shipped printhead comprising the steps of:

providing a dry printhead having a film of a liquid solvent deposited on a surface an ink pathway in the printhead, the solvent having a boiling point of at least 150 degrees; and priming the printhead with ink, wherein the step of priming the printhead dissolves the film of liquid solvent together with organic contaminants solubilized by the liquid solvent during storage or shipment.

As used herein, the terms "dry", "drying", "dried" etc refer to substantial removal of water from ink pathways in a printhead. In the present context, drying does not require complete desiccation; only to the extent that liquids are relatively immobilized in the printhead.

As used herein, the term "printer" refers to any printing device for marking print media, such as conventional desktop printers, label printers, duplicators, copiers and the like.

As used herein, the term "ink" refers to any printable fluid, including conventional dye-based and pigment-based inks, infrared inks, UV curable inks, 3D printing fluids, biological fluids, colorless ink vehicles etc.

DETAILED DESCRIPTION

Ink Pathways in Inkjet Printheads

Figure 1:
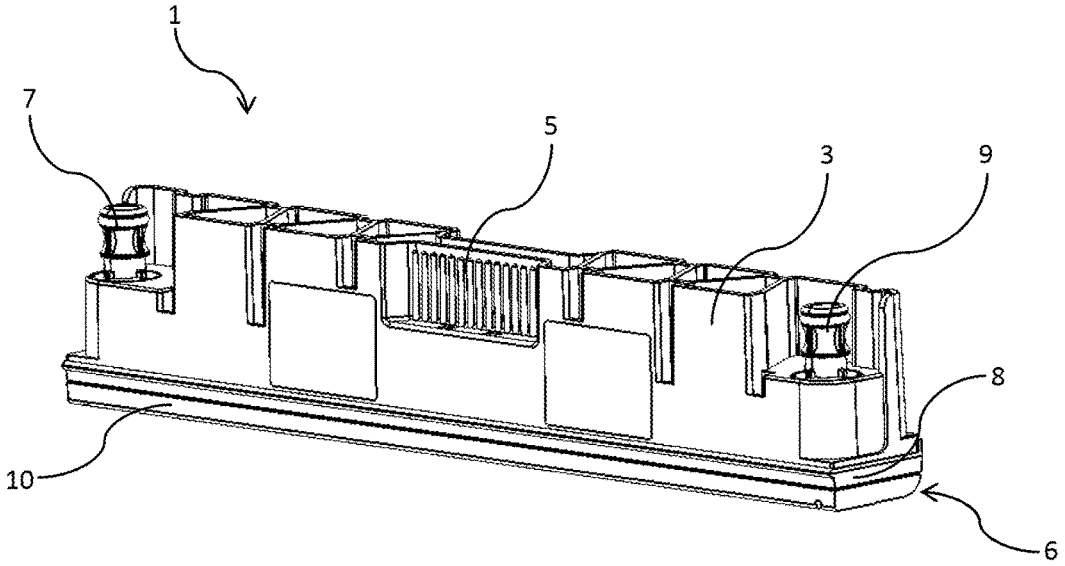
FIG. 1 is a top perspective of an inkjet printhead.

FIG. 1 shows an inkjet printhead 1 having a plurality of ink pathways defined by various channel structures in the printhead. The printhead 1 comprises an elongate body 3 having a central gripping portion 5 for facilitating user removal and insertion. A first coupling 7 is positioned towards one longitudinal end of the elongate body 3 and a second fluid coupling 9 is positioned towards an opposite longitudinal end of the elongate body. The first and second fluid couplings 7 and 9 are configured for coupling with complementary fluid couplings (not shown) of, for example, an ink delivery module supplying ink to and from the printhead 1.

The body 3 provides stiffness and support for an ink manifold assembly 6 attached to the body via a snap-fitting engagement. The ink manifold assembly 6 comprises an upper ink manifold 8 and a lower ink manifold 10, which are in fluid communication with the fluid couplings 7 and 9 of the body 3. The upper and lower ink manifolds 8 and 10 are typically comprised of a rigid, stiff material, such as a liquid crystal polymer (LCP) although other rigid materials (e.g. glass, ceramic etc) are of course within the ambit of the present invention.

Figure 2:
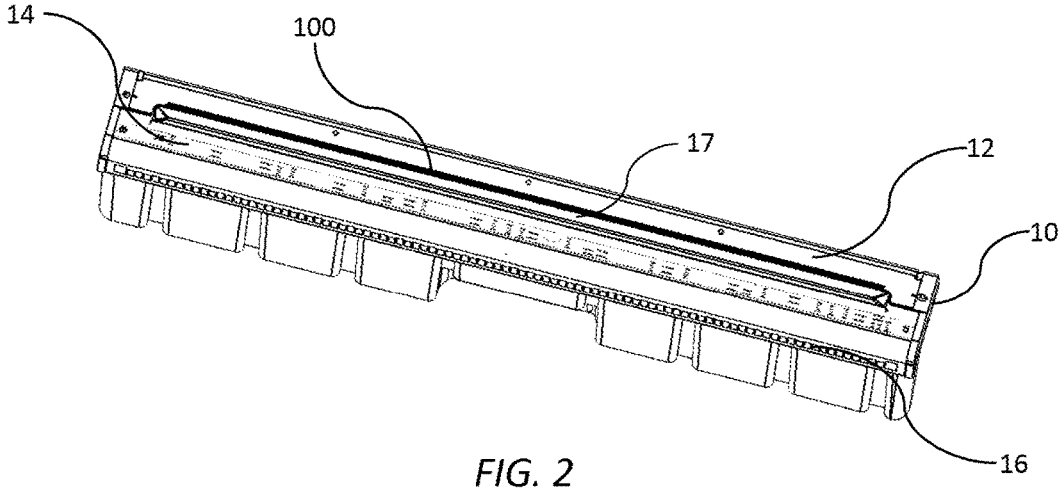
FIG. 2 is a bottom perspective of the inkjet printhead shown in FIG. 1.

Turning to FIG. 2, an array of printhead integrated circuits ("chips") 100 are butted end-to-end in a line and attached to an underside of the lower ink manifold 10 via a die-attach film 12. The die-attach film 12 may comprise a double-sided adhesive film with suitable laser-drilled openings for delivering ink, as described in, for example, U.S. Pat. No. 7,736,458 and US U.S. Pat. No. 7,845,755, the contents of which are incorporated herein by reference. The printhead chips 100 receive power and data signals from a flex PCB 14 wrapped around the ink manifold 10, the flex PCB in turn receiving power and data signals from a printer controller (not shown) via a series of electrical contacts 16 extending longitudinally extending along the printhead 1. Each printhead chip 100 receives data and power from the flex PCB 20 via wire bonds, which are protected with an encapsulant material 17 extending along one longitudinal edge region of each printhead chip. Suitable wirebonding arrangements will be well known to the person skilled in the art and are described, in for example, U.S. Pat. No. 8,025,204, the contents of which are incorporated herein by reference.

Figure 3:
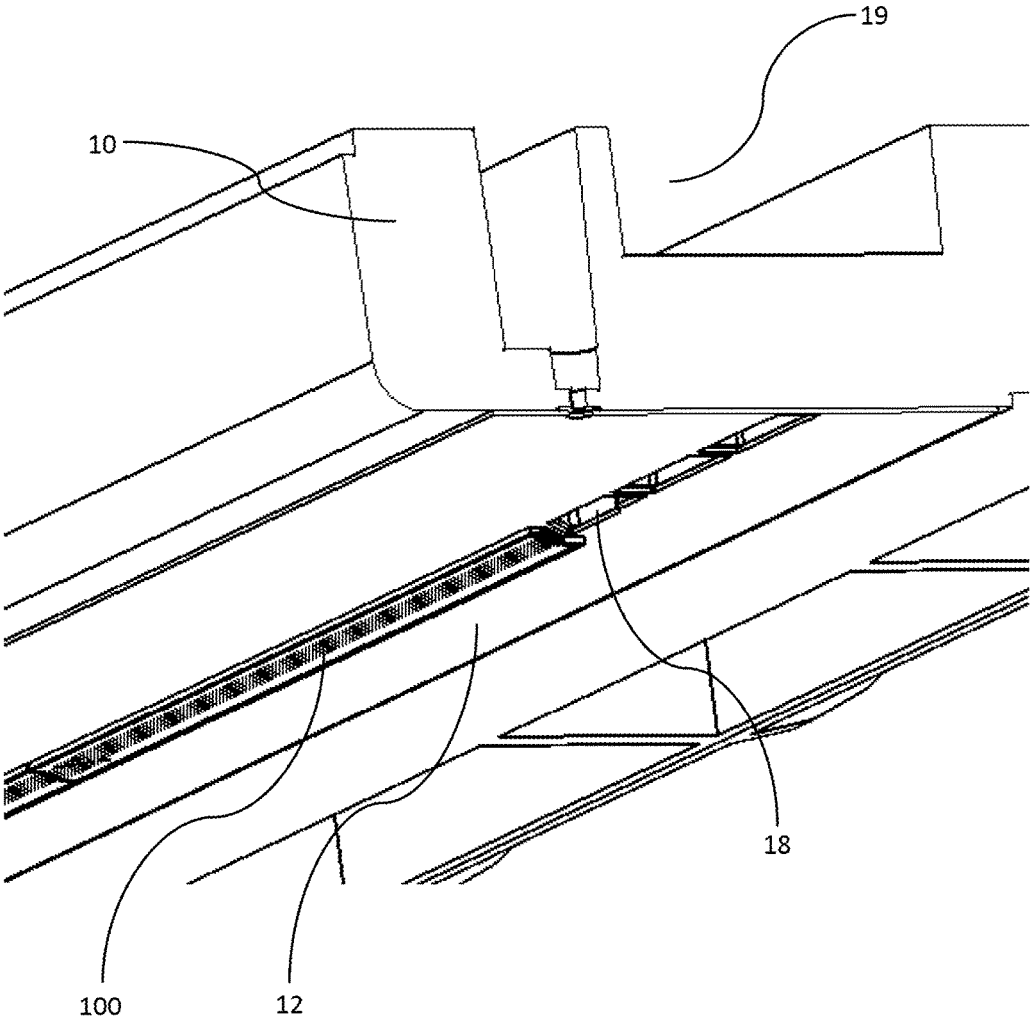
FIG. 3 is a perspective view of printhead chips mounted to an ink manifold.

Referring to FIG. 3, the die-attach film 12 has a plurality of slot openings 18 for delivering ink from ink delivery channels 19 of the lower ink manifold 10 to backside inlet channels of the printhead chips 100. Further details of the inkjet printhead 1 having the ink manifold assembly 6 can be found in U.S. application Ser. No. 15/583,099 filed 1 May 2017, the contents of which are incorporated herein by reference.

Figure 4:
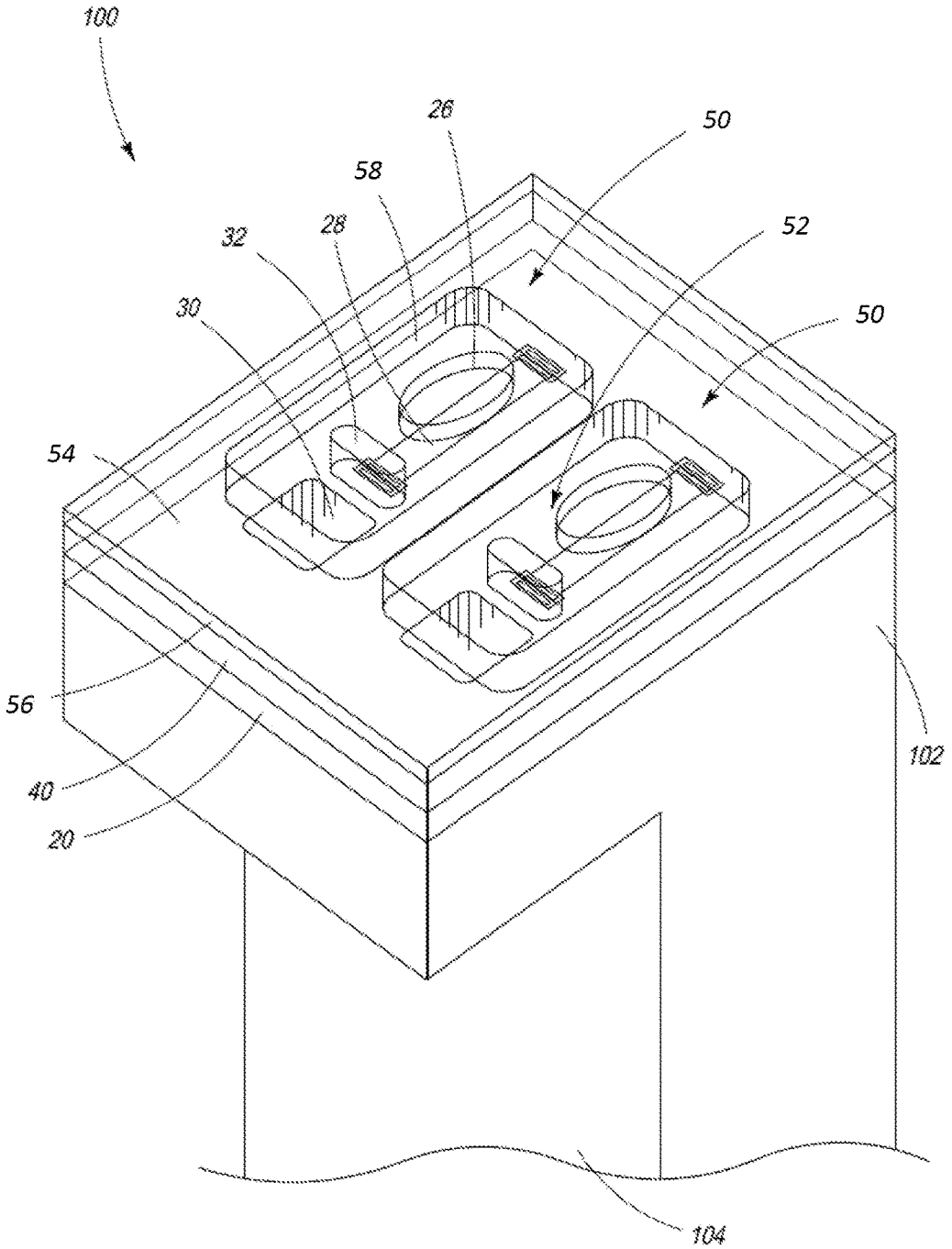
FIG. 4 is a magnified view of part of a printhead chip showing two inkjet nozzle devices.

Referring to FIG. 4, each printhead chip 100 comprises a plurality of inkjet nozzle devices 50 according to the present invention. The inkjet nozzle device 50 comprises a main chamber 52 having a floor 54, a roof 56 and a perimeter wall 58 extending between the floor and the roof. Typically, the floor is defined by a passivation layer covering a CMOS layer 20 containing drive circuitry for each actuator of the printhead. FIG. 4 shows the CMOS layer 20, which may comprise a plurality of metal layers interspersed with interlayer dielectric (ILD) layers.

In FIG. 4 the roof 56 is shown as a transparent layer so as to reveal details of each nozzle device 50. Typically, the roof 56 is comprised of a material, such as silicon dioxide or silicon nitride.

Figure 5:
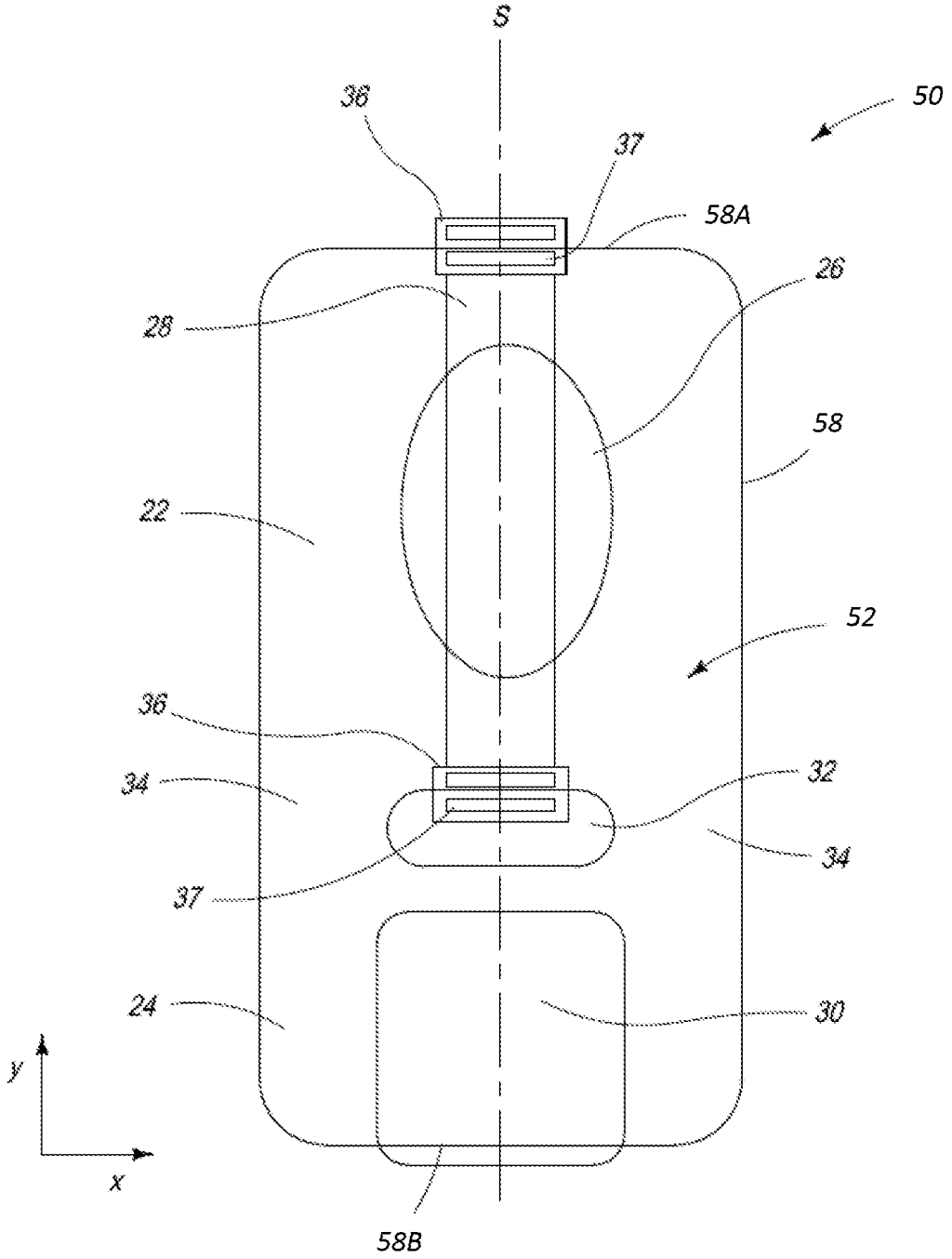
FIG. 5 is a plan view of an inkjet nozzle device.

Referring now to FIG. 5, the main chamber 52 of the nozzle device 50 comprises a firing chamber 22 and an antechamber 24. The firing chamber 22 comprises a nozzle aperture 26 defined in the roof 56 and an actuator in the form of a resistive heater element 28 bonded to the floor 54. The antechamber 24 comprises a main chamber inlet 30 ("floor inlet 30") defined in the floor 54.

The main chamber inlet 30 meets and partially overlaps with an endwall 58B of the antechamber 24. This arrangement optimizes the capillarity of the antechamber 24, thereby encouraging priming and optimizing chamber refill rates.

A baffle plate 32 partitions the main chamber 52 to define the firing chamber 22 and the antechamber 24. The baffle plate 32 extends between the floor 54 and the roof 56 and has rounded side edges so as to minimize the risk of roof cracking.

The nozzle device 50 has a plane of symmetry extending along a nominal y-axis of the main chamber 52. The plane of symmetry is indicated by the broken line S in FIG. 5 and bisects the nozzle aperture 26, the heater element 28, the baffle plate 32 and the main chamber inlet 30.

The antechamber 24 fluidically communicates with the firing chamber 22 via a pair of firing chamber entrances 34 which flank the baffle plate 32 on either side thereof. Each firing chamber entrance 34 is defined by a gap extending between a respective side edge of the baffle plate 32 and the perimeter wall 18. Typically, the baffle plate 32 occupies about half the width of the main chamber 12 along the x-axis, although it will be appreciated that the width of the baffle plate may vary based on a balance between optimal refill rates and optimal symmetry in the firing chamber 22. Each firing chamber entrance 34 may have a width of less than 15 microns or less than 10 microns.

The nozzle aperture 26 is elongate and takes the form of an ellipse having a major axis aligned with the plane of symmetry S. The heater element 28 takes the form of an elongate bar having a central longitudinal axis aligned with the plane of symmetry S. Hence, the heater element 28 and elliptical nozzle aperture 26 are aligned with each other along their y-axes.

The heater element 28 extends between an end wall 58A of the firing chamber 22 (defined by one side of the perimeter wall 58) and the baffle plate 32. The heater element 28 is connected at each end thereof to respective electrodes 36 exposed through the floor 14 of the main chamber 12 by one or more vias 37. Typically, the electrodes 36 are defined by an upper metal layer of the CMOS layer 20. The heater element 28 may be comprised of, for example, titanium-aluminium alloy, titanium aluminium nitride etc. In one embodiment, the heater element 28 may be coated with one or more protective layers, as known in the art. Suitable protective layers include, for example, silicon nitride, silicon oxide, tantalum etc.

The vias 37 may be filled with any suitable conductive material (e.g. copper, aluminium, tungsten etc.) to provide electrical connection between the heater element 28 and the electrodes 36. A suitable process for forming electrode connections from the heater element 28 to the electrodes 36 is described in U.S. Pat. No. 8,453,329, the contents of which are incorporated herein by reference.

The partial cutaway view of the printhead chip 100 in FIG. 4 shows only two inkjet nozzle devices 50 for clarity. The printhead chip 100 is defined by a silicon substrate 102 having the passivated CMOS layer 20 and a MEMS layer containing the inkjet nozzle devices 50. As shown in FIG. 4, each chamber inlet 30 meets with an ink supply channel 104 defined in a backside of the printhead 100. Each ink supply channel 104 extends parallel with one or more rows of nozzle devices 50 disposed at a frontside of the printhead chip 100. The ink supply channels 104 receive from the plurality of slot openings 18 in the lower ink manifold 10 (FIG. 3) and supply ink to nozzle rows via the chamber inlets 30. Further details of the printhead chips 100 can be found in the U.S. Pat. No. 9,044,945, the contents of which are incorporated herein by reference.

From the foregoing, it will be appreciated that certain portions of ink pathways in the printhead 1 may have a width of less than 10 microns. These pinch points in the ink pathways are susceptible to clogging during dry storage or dry shipment of the printhead 1 due to leaching or outgassing of organic material from, for example the polymeric encapsulant 17, various glue joints or potting compounds in the printhead.

Treatment Fluids

The treatment fluids used in the present invention are aqueous fluids comprising at least 80 wt % water, at least 90 wt % water or at least 95 wt % water. Optimally, the amount of water present in the treatment fluid is in the range of 97 to 99 wt %.

Suitable ink-soluble organic solvents include: glycols, such as ethylene glycol, diethylene glycol, triethylene glycol, tetraethylene glycol and pentaethylene glycol; glycol ethers, such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-isopropyl ether, diethylene glycol mono-isopropyl ether, ethylene glycol mono-n-butyl ether, diethylene glycol mono-n-butyl ether, triethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-isopropyl ether, dipropylene glycol monomethyl ether, dipropylene glycol monoethyl ether, dipropylene glycol mono-n-propyl ether, dipropylene glycol mono-isopropyl ether, propylene glycol mono-n-butyl ether, and dipropylene glycol mono-n-butyl ether; formamide; acetamide; sorbitol; sorbitan; glycerol monoacetate; glycerol diacetate; glycerol triacetate; and sulfolane.

Other useful ink-soluble organic solvents include polar solvents, such as 2-pyrrolidone, N-methylpyrrolidone, 2-hydroxyethylpyrrolidone, ε-caprolactam, dimethyl sulfoxide, morpholine, N-ethylmorpholine, 1,3-dimethyl-2-imidazolidinone.

Other examples of high-boiling water-soluble organic solvents suitable for use in the treatment fluid include humectants, such as 2-butene-1,4-diol, 2-ethyl-1,3-hexanediol, 2-methyl-2,4-pentanediol, tripropylene glycol monomethyl ether, dipropylene glycol monoethyl glycol, dipropylene glycol monoethyl ether, dipropylene glycol monomethyl ether, dipropylene glycol, triethylene glycol monomethyl ether, diethylene glycol monobutyl ether, diethylene glycol monoethyl ether, diethylene glycol monomethyl ether, tripropylene glycol, polyethylene glycols having molecular weights of 2000 or lower, 1,3-propylene glycol, isopropylene glycol, isobutylene glycol, 1,4-butanediol, 1,3-butanediol, 1,5-pentanediol, 1,6-hexanediol, glycerol, trimethylolpropane, erythritol and pentaerythritol, as well as ethoxylated derivative thereof and combinations thereof.

The treatment fluid may also contain one or more surface active agents ("surfactants"), such as an anionic surface active agent, a zwitterionic surface active agent, a nonionic surface active agent or mixtures thereof. Useful anionic surface active agents include sulfonic acid types, such as alkanesulfonic acid salts, α-olefinsulfonic acid salts, alkylbenzenesulfonic acid salts, alkylnaphthalenesulfonic acids, acylmethyltaurines, and dialkylsulfosuccinic acids; alkylsulfuric ester salts, sulfated oils, sulfated olefins, polyoxyethylene alkyl ether sulfuric ester salts; carboxylic acid types, e.g., fatty acid salts and alkylsarcosine salts; and phosphoric acid ester types, such as alkylphosphoric ester salts, polyoxyethylene alkyl ether phosphoric ester salts, and glycerophosphoric ester salts. Specific examples of the anionic surface active agents are sodium dodecylbenzenesulfonate, sodium laurate, and a polyoxyethylene alkyl ether sulfate ammonium salt.

Examples of zwitterionic surface active agents include N,N-dimethyl-N-octyl amine oxide, N,N-dimethyl-N-dodecyl amine oxide, N,N-dimethyl-N-tetradecyl amine oxide, N,N-dimethyl-N-hexadecyl amine oxide, N,N-dimethyl-N-octadecyl amine oxide and N,N-dimethyl-N—(Z-9-octadecenyl)-N-amine oxide.

Examples of nonionic surface active agents include ethylene oxide adduct types, such as polyoxyethylene alkyl ethers, polyoxyethylene alkylphenyl ethers, polyoxyethylene alkyl esters, and polyoxyethylene alkylamides; polyol ester types, such as glycerol alkyl esters, sorbitan alkyl esters, and sugar alkyl esters; polyether types, such as polyhydric alcohol alkyl ethers; and alkanolamide types, such as alkanolamine fatty acid amides. Specific examples of nonionic surface active agents are ethers such as polyoxyethylene nonylphenyl ether, polyoxyethylene octylphenyl ether, polyoxyethylene dodecylphenyl ether, polyoxyethylene alkylallyl ether, polyoxyethylene oleyl ether, polyoxyethylene lauryl ether, and polyoxyalkylene alkyl ethers (e.g. polyoxyethylene alkyl ethers); and esters, such as polyoxyethylene oleate, polyoxyethylene oleate ester, polyoxyethylene distearate, sorbitan laurate, sorbitan monostearate, sorbitan mono-oleate, sorbitan sesquioleate, polyoxyethylene mono-oleate, and polyoxyethylene stearate.

Acetylene glycol surface active agents, such as 2,4,7,9-tetramethyl-5-decyne-4,7-diol; ethoxylated 2,4,7,9-tetramethyl-5-decyne-4,7-diol; 3,6-dimethyl-4-octyne-3,6-diol or 3,5-dimethyl-1-hexyn-3-ol, may also be used. Specific examples of nonionic surfactants, which may be used in the treatment fluid, are Surfynol® 465 and Surfynol® 440 (available from Air Products and Chemicals, Inc).

The treatment fluid may also include a pH adjuster and/or buffer, such as sodium hydroxide, potassium hydroxide, lithium hydroxide, sodium carbonate, sodium hydrogencarbonate, potassium carbonate, potassium hydrogencarbonate, lithium carbonate, sodium phosphate, potassium phosphate, lithium phosphate, potassium dihydrogenphosphate, dipotassium hydrogenphosphate, sodium oxalate, potassium oxalate, lithium oxalate, sodium borate, sodium tetraborate, potassium hydrogenphthalate, and potassium hydrogentartrate; ammonia; and amines, such as methylamine, ethylamine, diethylamine, trimethylamine, triethylamine, tris(hydroxymethyl)aminomethane hydrochloride, triethanolamine, diethanolamine, diethylethanolamine, triisopropanolamine, butyldiethanolamine, morpholine, propanolamine, 4-morpholineethanesulfonic acid and 4-morpholinepropanesulfonic acid ("MOPS").

The treatment fluid may also include a biocide, such as benzoic acid, dichlorophene, hexachlorophene, sorbic acid, hydroxybenzoic esters, sodium dehydroacetate, 1,2-benthiazolin-3-one ("Proxel® GXL", available from Arch Chemicals, Inc.), 3,4-isothiazolin-3-one or 4,4-dimethyloxazolidine. The amount of biocide, when present, is typically in the range of from 0.01 to 0.5 wt %, irrespective of any dilution factor for other ingredients in the treatment fluid.

A preferred treatment fluid contains ethylene glycol and glycerol as the ink-soluble solvents.

Experimental

A treatment fluid ("TF") was prepared by mixing the ingredients shown in Table 1.

TABLE 1

Treatment Fluid

| Ingredient | Amount (wt. %) |
|---|---|
| Ethylene glycol | 12 |
| Glycerol | 3 |
| MOPS[1] | 0.2 |
| Proxel ® GXL[2] | 0.04 |
| 2M NaOH | adjust to pH 7.2 |
| DI water | balance |

[1]MOPS is 3-(N-morpholino)propanesulfonic acid

[2]The biocide (Proxel ® GXL) is adjusted to 0.04 wt. % in all diluted treatment fluids shown in Table 2

Memjet® ML210700 printheads were treated with the treatment fluid at various dilutions by flushing the treatment fluid through ink pathways in the printhead. The printhead was subsequently dried by air-drying and subjected to accelerated storage conditions: 2 weeks storage at room temperature followed by 2 weeks storage at 70° C. Each dry printhead was subsequently analysed by means of a Dead Nozzle Count ("DNC") after storage. The number of dead nozzles after dry storage for variously treated printheads are shown in Table 2.

TABLE 2

Comparison of treated printheads after dry storage

| Example No. | Treatment Fluid | DNC after storage |
|---|---|---|
| Comparative Example 1 | DI water | 2145 |
| Comparative Example 2 | DI water | 1215 |
| Example 1 | 1% TF in DI water | 964 |
| Example 2 | 10% TF in DI water | 6 |
| Example 3 | 10% TF in DI water | 1 |
| Example 4 | TF (undiluted) | 17 |
| Example 5 | TF (undiluted) | 21 |

The results in Table 2 show that the Dead Nozzle Count of dry printheads was significantly improved by treatment with the treatment fluid ("TF") prior to storage when compared to treatment with deionized water. Surprisingly, printheads treated with a 10% solution of treatment fluid (Examples 2 and 3) provided the lowest number of dead nozzles. Example 1 (1% solution of TF) reduced the number of dead nozzles somewhat, but still produced a relatively high number of dead nozzles after storage. Examples 4 and 5 (undiluted TF) gave a higher number of dead nozzles compared to Examples 2 and 3, indicating that the total solvent content of the treatment fluid is optimally within a range of about 0.5 to 3 wt. %.

It will, of course, be appreciated that the present invention has been described by way of example only and that modifications of detail may be made within the scope of the invention, which is defined in the accompanying claims.

The invention claimed is:

1. A method of preparing a printhead for dry shipment comprising the steps of:

treating an ink pathway in the printhead with an aqueous treatment fluid comprising at least one ink-soluble solvent having a boiling point of at least 150 degrees; and drying the printhead so as to leave a film of liquid solvent on a surface of the ink pathway, the film of liquid solvent solubilizing organic materials leached or volatilized from the printhead during dry storage or shipment.

2. The method of claim 1, further comprising the step of packaging the printhead.

3. The method of claim 1, wherein the printhead is packaged together with one or more of: a desiccant; and an oxygen scavenger.

4. The method of claim 1, wherein the organic materials are leached from at least one of: glue joints in the printhead; and a polymer encapsulating electrical connections in the printhead.

5. The method of claim 1, wherein the ink-soluble solvent is selected from the group consisting of: glycols, glycol ethers, sulfolane, glycerol, trimethylolpropane, 2-pyrrolidone, N-methylpyrrolidone and morpholine.

6. The method of claim 1, wherein the treatment fluid comprises one or more ingredients selected from the group consisting of: surfactants, biocides and buffers.

7. The method of claim 1, wherein a total solvent content of the treatment fluid is in the range of 0.5 to 3 wt. %.

8. The method of claim 1, wherein a portion of the ink pathway has a width of less than 20 microns.

9. A dry-shipped printhead comprising a printhead contained in a sealed package, wherein a film of liquid solvent is deposited on a surface of an ink pathway in the printhead, and wherein the solvent is ink-soluble and has a boiling point of at least 150 degrees.

10. The dry-shipped printhead of claim 9, wherein the liquid solvent contains solubilized organic material leached or volatilized from the printhead during dry storage or shipment.

11. The dry-shipped printhead of claim 9, wherein the film of liquid solvent is immobile.

12. The dry-shipped printhead of claim 9, wherein the package additionally contains a desiccant.

13. A method of priming a dry-shipped printhead comprising the steps of:

providing a dry printhead having a film of a liquid solvent deposited on a surface an ink pathway in the printhead, the solvent having a boiling point of at least 150 degrees; and priming the printhead with ink, wherein the step of priming the printhead dissolves the film of liquid solvent together with organic contaminants solubilized by the liquid solvent during storage or shipment.

14. The method of claim 8, wherein the solvent is selected from the group consisting of: glycols, glycol ethers, sulfolane, glycerol, trimethylolpropane, 2-pyrrolidone, N-methylpyrrolidone and morpholine.

* * * * *